US011485009B2

(12) United States Patent
Hsieh

(10) Patent No.: US 11,485,009 B2
(45) Date of Patent: Nov. 1, 2022

(54) EXTENDABLE WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 360 days.

(21) Appl. No.: 16/821,645

(22) Filed: Mar. 17, 2020

(65) Prior Publication Data

US 2020/0338714 A1 Oct. 29, 2020

(30) Foreign Application Priority Data

Apr. 25, 2019 (TW) ..... 10811457.8

(51) Int. Cl.

| | |
|---|---|
| ***B25G 1/04*** | (2006.01) |
| ***B25B 23/16*** | (2006.01) |
| ***B25B 23/00*** | (2006.01) |
| *B25B 13/46* | (2006.01) |

(52) U.S. Cl.

CPC ..... *B25G 1/043* (2013.01); *B25B 23/16* (2013.01); *B25B 13/462* (2013.01); *B25B 23/0028* (2013.01); *B25B 23/0035* (2013.01)

(58) Field of Classification Search

CPC . B25B 23/16; B25B 23/0028; B25B 23/0035; B25G 1/043

See application file for complete search history.

(56) References Cited

U.S. PATENT DOCUMENTS

| | | | | |
|---|---|---|---|---|
| 6,131,490 | A * | 10/2000 | Lee | B25B 13/461 81/177.2 |
| 6,336,382 | B2 * | 1/2002 | Cerda | B25B 13/461 81/177.85 |
| 6,523,440 | B2 * | 2/2003 | Friedman | B25B 13/04 81/186 |
| 7,044,028 | B1 * | 5/2006 | Lozano | B25B 23/0021 81/177.85 |
| 2006/0016297 | A1 * | 1/2006 | Smith | B25B 13/04 81/177.2 |

(Continued)

FOREIGN PATENT DOCUMENTS

| | | | | |
|---|---|---|---|---|
| JP | 3113697 U | * | 9/2005 | |
| JP | 3147436 U | * | 12/2008 | |
| JP | 3190636 U | * | 5/2014 | B25B 13/38 |

*Primary Examiner* — David B. Thomas

(74) *Attorney, Agent, or Firm* — Guice Patents PLLC

(57) ABSTRACT

The present invention provides an extendable wrench comprising: a wrench having a head portion and a shaft connected to a rear end of the head portion; an insertion hole recessed at a rear end of the shaft; a cover to dismountably close the insertion hole; an extension rod with a front end formed with a plug to be plug-connected with or separated from the insertion hole of the wrench; and an elastic positioning member provided between the plug of the extension rod and the insertion hole of the wrench, when the plug of the extension rod is plug-connected with the insertion hole, the elastic positioning member keeps the plug in position. Thereby, the wrench can be operated independently; when application of larger operating torque is required, the extension rod can be combined with a rear end of the wrench to form a longer operating arm of force to meet the requirements of large torque.

15 Claims, 13 Drawing Sheets

(56) References Cited

U.S. PATENT DOCUMENTS

| | | | | |
|---|---|---|---|---|
| 2007/0131070 | A1* | 6/2007 | Hull | B25B 13/461 81/489 |
| 2009/0013834 | A1* | 1/2009 | Richardson | B25G 1/043 81/177.8 |
| 2010/0107828 | A1* | 5/2010 | Huerta | B25G 1/063 81/177.85 |
| 2014/0260829 | A1* | 9/2014 | Alfinito | B25B 23/0021 81/177.85 |
| 2020/0086474 | A1* | 3/2020 | Avalos | B25B 23/0021 |

* cited by examiner

EXTENDABLE WRENCH

BACKGROUND OF THE INVENTION

Field of Invention

The present invention relates to a wrench, and more particularly to a torque wrench capable of extending an operating arm of force.

Related Art

FIG. 1 shows a conventional ratchet wrench 10, which has a head portion 12, a shaft 14, and a handle 16. Inside the head portion 12 is provided with a ratchet mechanism; the shaft 14 and the handle 16 are solid structures. The ratchet wrench 10 has a fixed length, and lengths of the shaft 14 and the handle 16 are short, and therefore the ratchet wrench 10 cannot provide a high torque.

In order to increase the arm of force of the wrench, it is disclosed in the prior art that the shaft of the wrench is made with a retractable structure. The shaft is made with inner and outer tubes, the inner and outer tubes are sleeved with each other, and the outer tube can be movably slid on the inner tube to change the length of the shaft. However, this design must be provided with a positioning structure between the inner and outer tubes for positioning the outer tube. In this way, the structural strength of the inner and outer tubes will be reduced. Therefore, this type of wrench with the retractable structure is not suitable for high-torque application.

Although the conventional wrench is disclosed with the technique that the handle of the wrench can be extended, it still cannot meet the requirements of high torque.

SUMMARY OF THE INVENTION

An object of the present invention is to provide a wrench having a design capable of extending an arm of force to provide a large torque.

Another object of the present invention is to provide a wrench having better structural strength to withstand high-torque operation.

An extendable wrench provided by the present invention comprises:

a wrench having a head portion and a shaft connected to a rear end of the head portion;

an insertion hole recessed at a rear end of the shaft;

a cover dismountably installed at the rear end of the shaft to close the insertion hole;

an extension rod with a length at least half of a length of the shaft, a plug is formed at a front end of the extension rod, the plug of the extension rod is capable of plug-connecting with or separating from the insertion hole of the wrench; and an elastic positioning member provided between the plug of the extension rod and the insertion hole of the wrench, when the plug of the extension rod is plug-connected with the insertion hole, the elastic positioning member keeps the plug in position.

Thereby, the wrench can be operated independently; when application of larger operating torque is required, the extension rod can be combined with a rear end of the wrench to form a longer operating arm of force to meet the requirements of large torque.

Preferably, at least one groove is provided on a peripheral surface of the shaft of the wrench along a longitudinal direction of the shaft, so as to enhance the structural strength of the shaft of the wrench to withstand high-torque operation.

Preferably, the wrench has an operating arm of force, which is a length formed between the head portion and the rear end of the shaft; an extended operating arm of force is formed when the extension rod being plug-connected with the wrench, which is a length formed between the head portion and a rear end of the extension rod, and a length of the extended operating arm of force is more than 1.5 times a length of the operating arm of force of the wrench.

BRIEF DESCRIPTION OF THE DRAWINGS

The objects, features and efficacies of the present invention can be understood from the description and drawings of the following preferred embodiments.

DETAILED DESCRIPTION OF THE INVENTION

Figure 2:
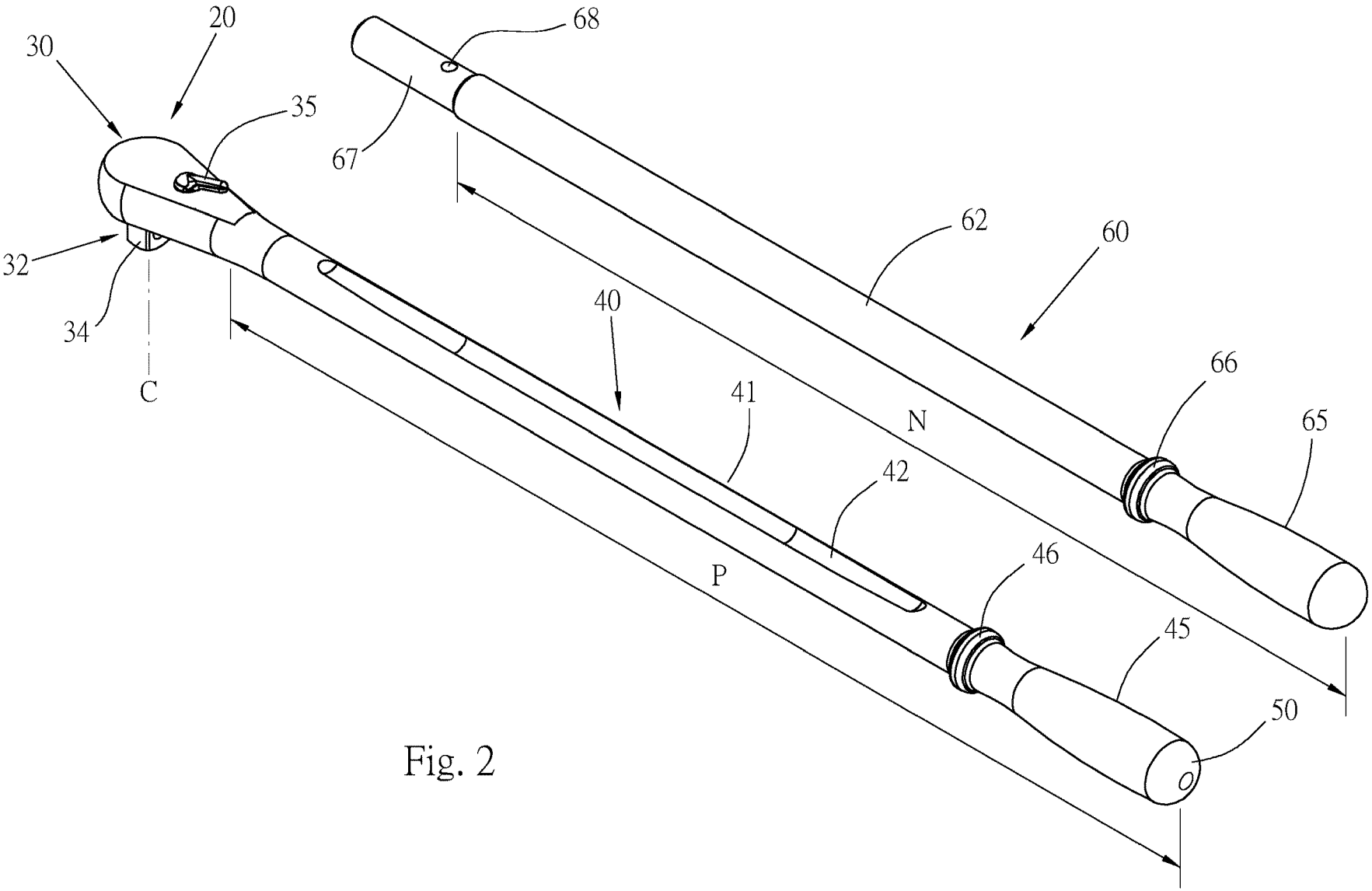
FIG. 2 is a perspective view of a wrench and an extension rod according to a first preferred embodiment of the present invention.
Figure 3:
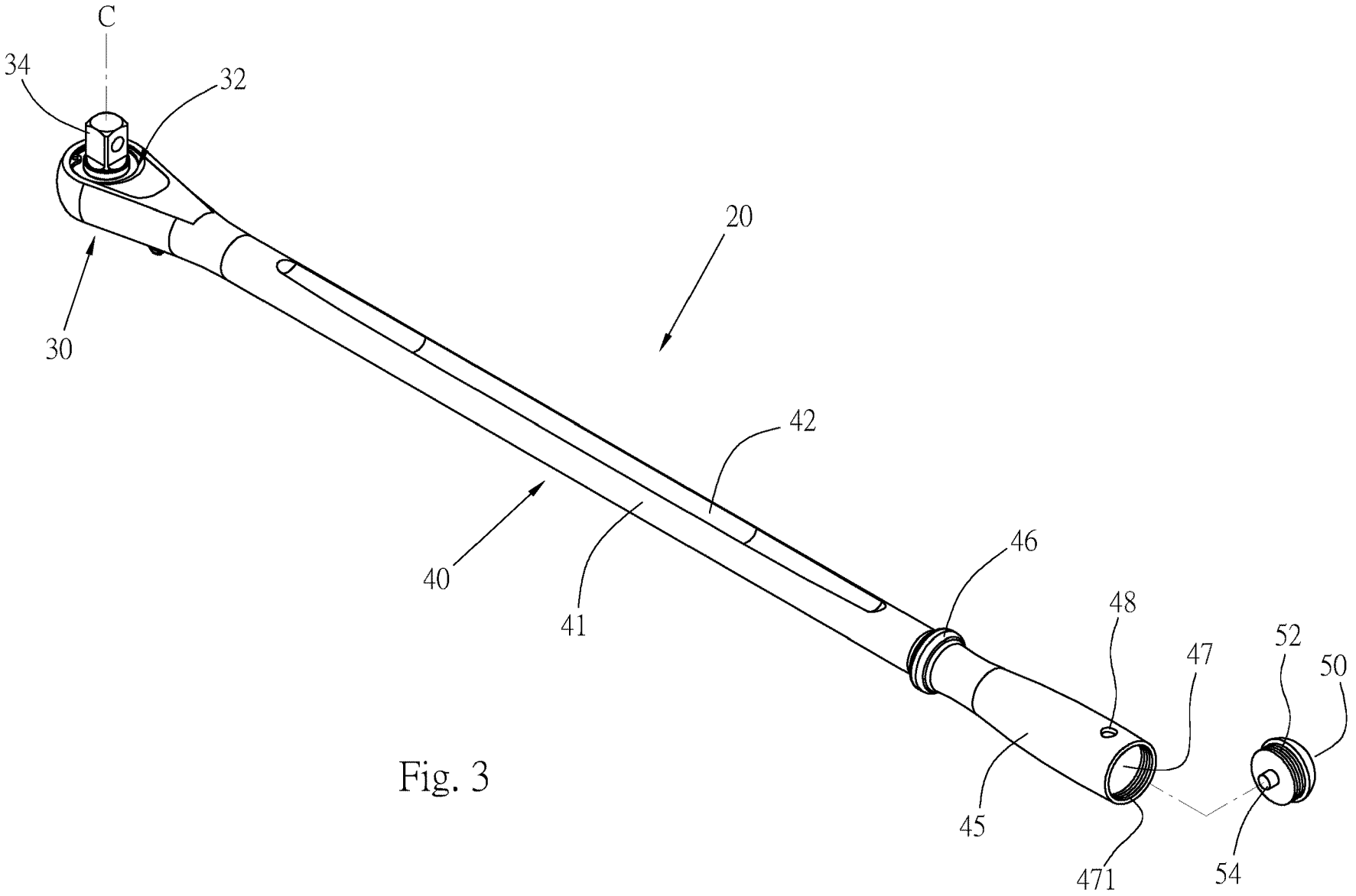
FIG. 3 is a bottom perspective view of the wrench of FIG. 2.

Please refer to FIG. 2 and FIG. 3, which are an extendable wrench provided by a first preferred embodiment of the present invention that includes: a wrench 20 and an extension rod 60 to form a wrench combination, and the wrench 20 can be used alone, or the extension rod 60 can be combined with the wrench 20 as needed to extend an operating arm of force of the wrench 20.

The wrench 20 is made of a metal material, and includes a head portion 30 and a shaft 40 connected to a rear end of the head portion 30, and the rear end of the head portion 30 is connected to a front end of the shaft 40. In this embodiment, the head portion 30 is integrally formed with the shaft 40.

Figure 4:
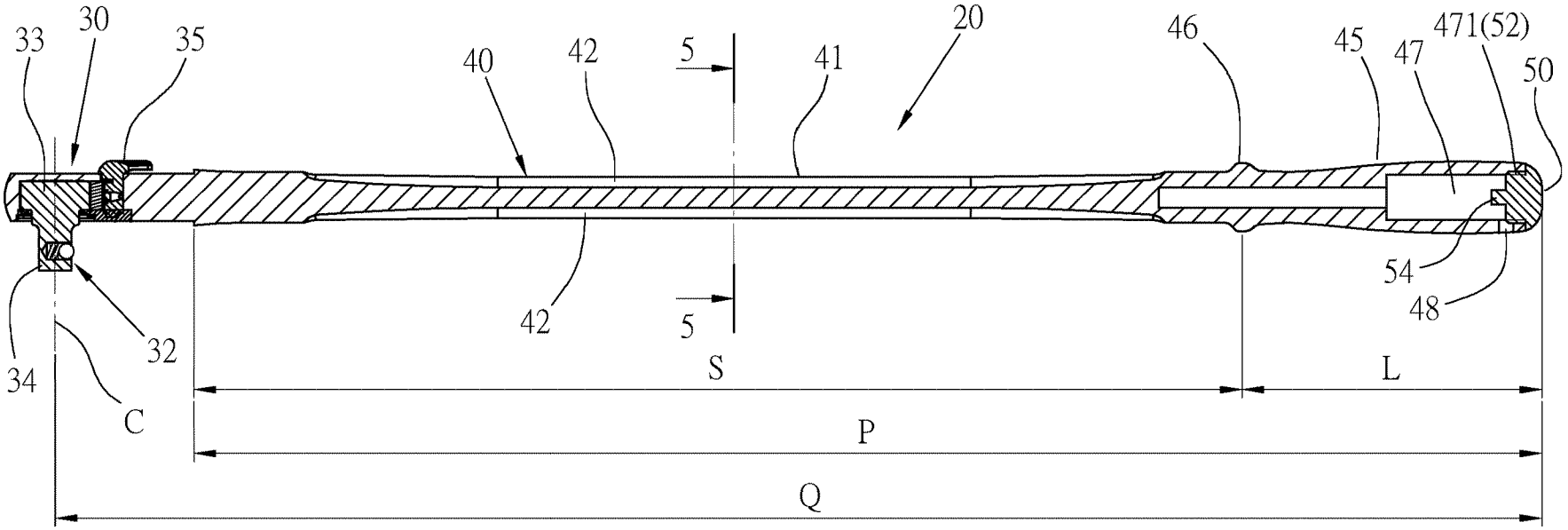
FIG. 4 is a longitudinal cross-sectional view of the wrench according to the first preferred embodiment of the present invention.

A driving member 32 is disposed at the head portion 30 and is used to combine with and drive a screw connection element such as a nut or a bolt, or a sleeve. The driving member 32 can be an insert column or a polygonal insertion hole or in other forms. The driving member 32 in this embodiment is a ratchet member having a ratchet 33, as shown in FIG. 4, and the ratchet 33 is provided with an insert column 34 for combining with a sleeve. A reversing button 35 is provided on the head portion 30 to control the rotational direction of the ratchet 33. The driving member 32 is not a main object of the present invention, and will not be described in detail. The driving member 32 has a center C. In this embodiment, the center C of the driving member 32 is located at a center of the insert column 34.

Figure 5:
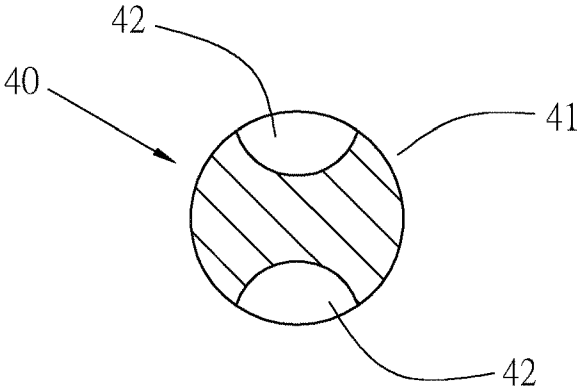
FIG. 5 is a cross-sectional view of a shaft body shown in FIG. 4 along sectioning line 5-5.

The shaft 40 is a solid structure with a considerable length, and is made into a shaft body 41 and a grip 45, the shaft body 41 and the grip 45 are connected in an integrated manner. A front end of the shaft body 41 is connected to the head portion 30, and a front end of the grip 45 is connected to a rear end of the shaft body 41. A length of the shaft body 41 is a multiple of a length of the grip 45. Please refer to FIG. 5, the shaft body 41 has a circular cross-section, one groove 42 is or more than one groove 42 are provided on a peripheral surface of the shaft body 41 along a longitudinal direction of the shaft body 41. This embodiment has two grooves 42, respectively recessed at a top edge and a bottom edge of the peripheral surface of the shaft body 41, and each of the grooves 42 also has a considerable length, which is only slightly shorter than the length of the shaft body 41. As shown in FIG. 5, with the two grooves 42, the shaft body 41 has an H-shaped geometric cross-section, so that a thickness of the shaft body 41 is larger sideways and a thickness inside the shaft body 41 is thinner. This configuration design can improve the structural strength of the shaft body 41 of the wrench 20 and the strain capacity of the shaft body 41. Moreover, a cross-section of each of the grooves 42 is arcuate, so that an inner wall surface of the groove 42 does not have sharp angles to prevent the problem of stress concentration.

The grip 45 also has a circular cross-section for an operator to hold; a circular protruding ring 46 is located at an intersection of the shaft body 41 and the grip 45, and an outer diameter of the protruding ring 46 is larger than a diameter of the shaft body 41 to increase the structural strength of the shaft 40.

The length of the shaft body 41 is a multiple of the length of the grip 45, such as twice or more than twice. Please refer to FIG. 4, in this preferred embodiment, the length of the shaft body 41 is not less than three times the length of the grip 45. Preferably, a length S of the shaft body 41 is 3.1~3.8 times of a length L of the grip 45.

Please refer to FIG. 3 and FIG. 4. An insertion hole 47 is recessed inwardly from an end of the shaft 40 (also an end of the grip 45). A hole wall of the insertion hole 47 is provided with a screw thread 471. A fasten hole 48 is also provided at the hole wall of the insertion hole 47, and the fasten hole 48 penetrates an outer peripheral surface of the shaft 40.

A cover 50 is also provided with a screw thread 52 on a peripheral surface thereof. The cover 50 is screwed and connected with the screw thread 471 of the insertion hole 47 to close the insertion hole 47. An abut stud 54 is protruded from an inner end surface of the cover 50.

The extension rod 60 is a solid structure with a length preferably more than half of a length of the shaft 40. In this preferred embodiment, the configuration of the extension rod 60 is the same as the configuration of the shaft 40, and a length N of the extension rod 60 is also approximately equal to a length P of the shaft 40. The extension rod 60 includes a shaft body, a grip, and a protruding ring connected to each other. The shaft body is a second shaft body 62, the grip is a second grip 65, and the protruding ring is a second protruding ring 66 located between the shaft body and the grip, an outer diameter of the protruding ring 66 is larger than an outer diameter of the shaft body 62. A plug 67 is formed at a front end of the extension rod 60; an elastic fastener 68 is provided at a peripheral surface of the plug 67. Please refer to FIG. 9, the elastic fastener 68 has an elastic element 681 and a fasten body 682 (such as a steel ball or a small cylinder), which are buried in a recess 671 of the plug 67. The fasten body 682 is elastically abutted and held by the elastic element 681, and partially exposed on the peripheral surface of the plug 67.

The aforementioned fasten hole 48 and the elastic fastener 68 form an elastic positioning member.

Figure 1:
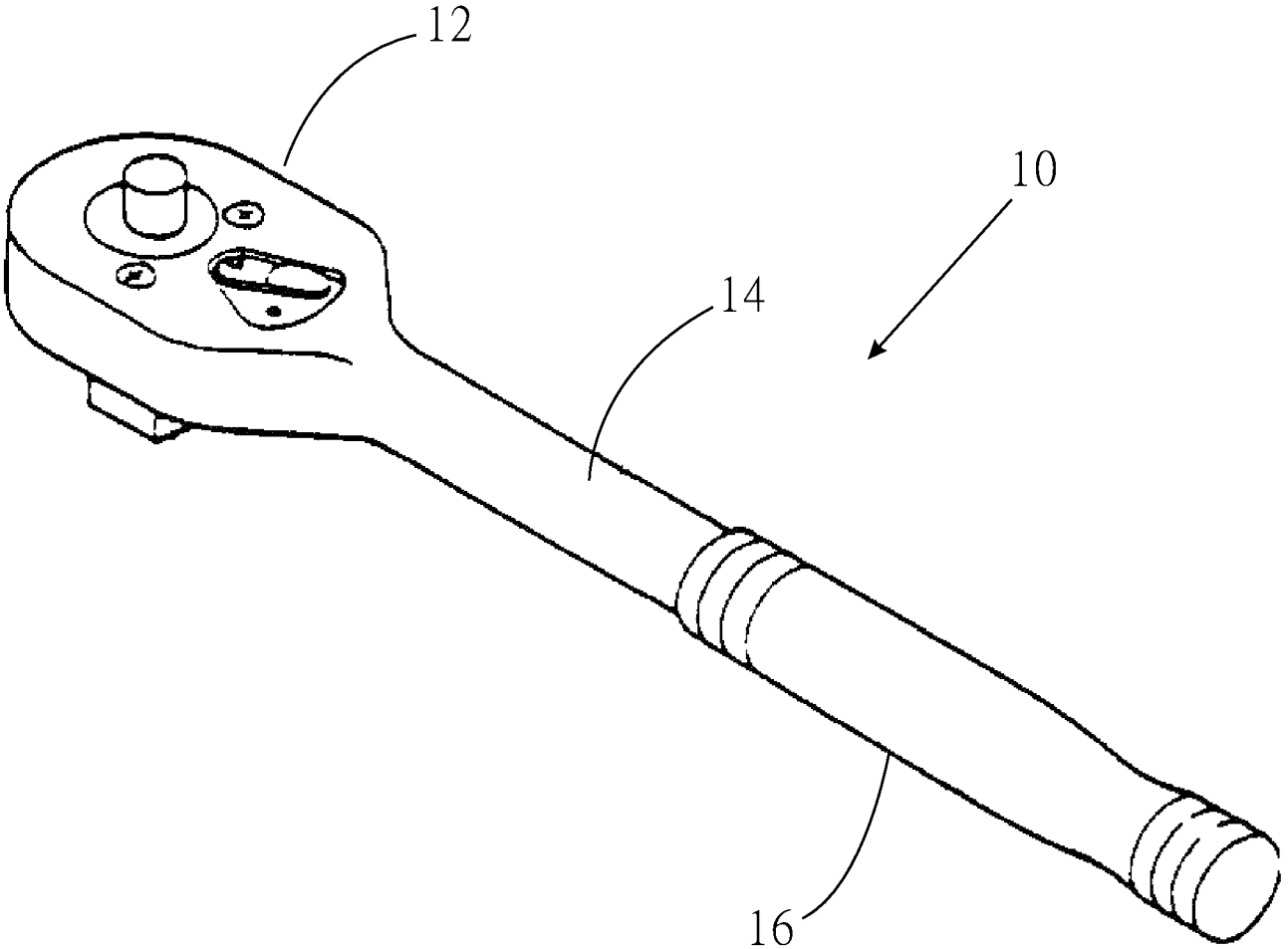
Fig. 1 PRIOR ART
FIG. 1 is a perspective view of a conventional ratchet wrench.
Figure 6:
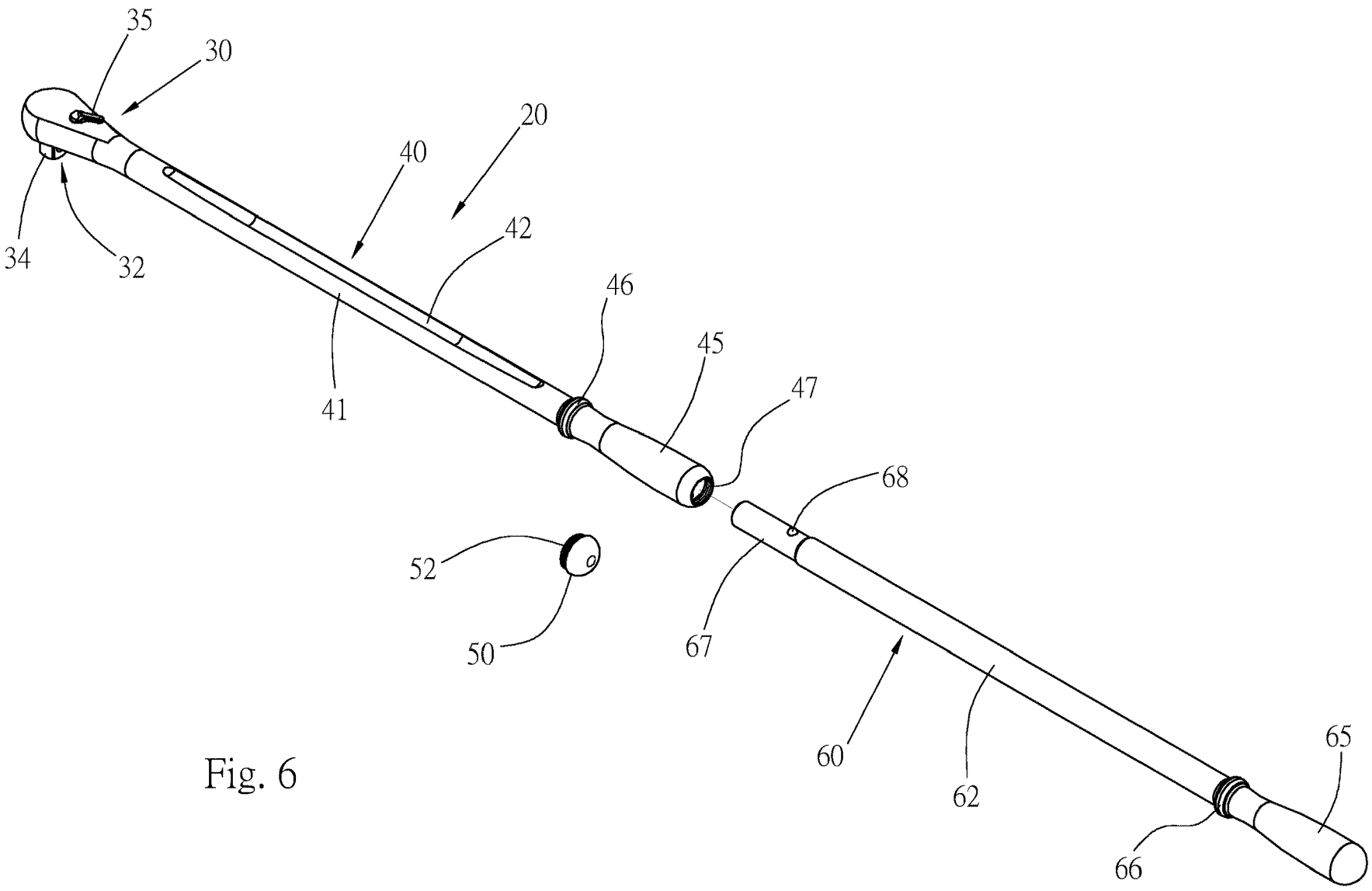
FIGS. 6 and 7 are perspective views of the combination of the wrench and the extension rod of FIG. 2.
Figure 7:
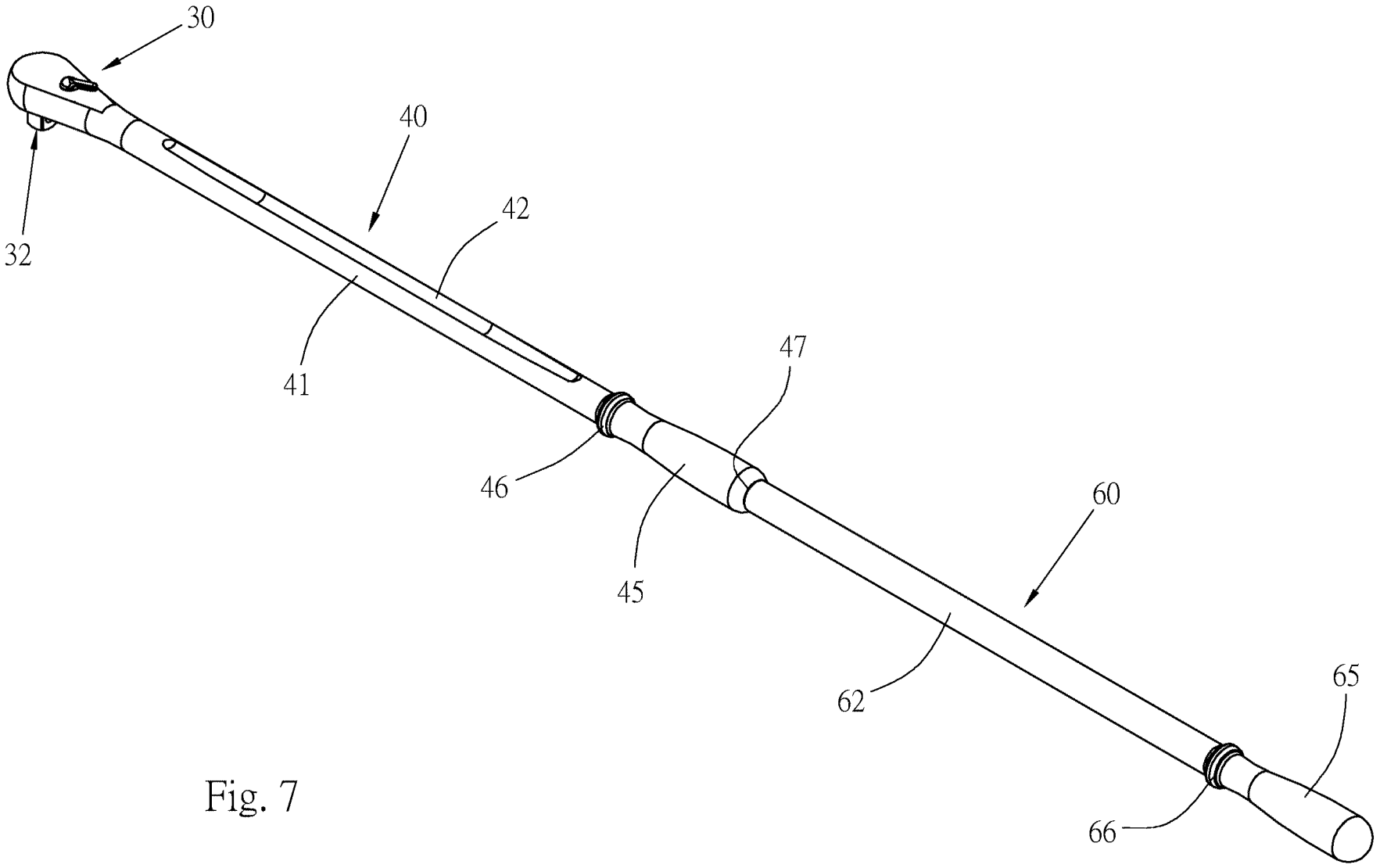
Figure 8:
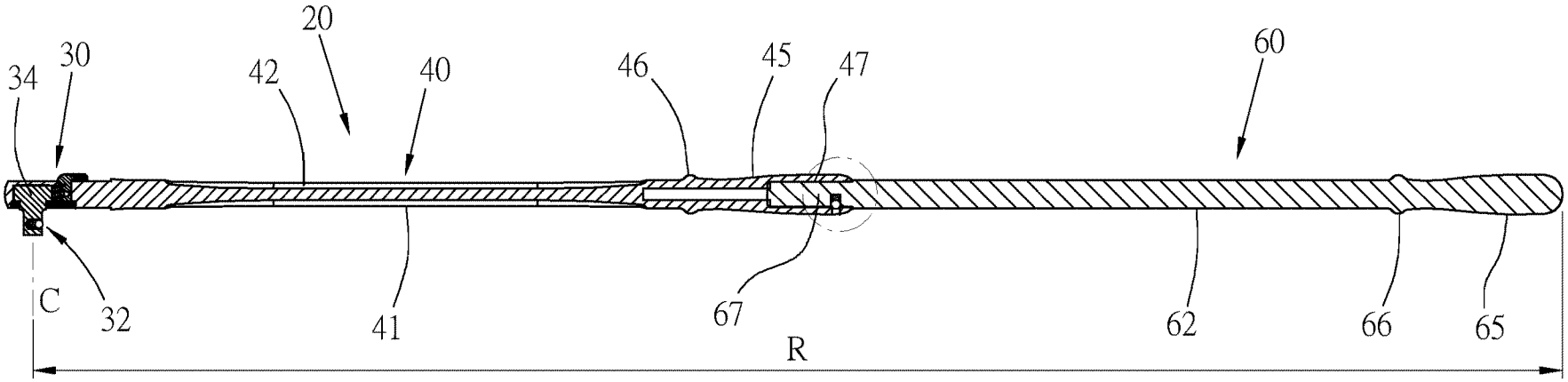
FIG. 8 is a longitudinal cross-sectional view of FIG. 7.

In the present invention, the wrench 20 can be used alone, or as shown in FIGS. 6 to 8, the extension rod 60 can be used in combination with the wrench 20. When the wrench 20 is used alone, a user holds the grip 45 to operate the wrench 20. A length from the center C of the driving member 32 to the end of the shaft 40 is an operating arm of force Q of the wrench 20 to turn a screw connection element or a sleeve, as shown in FIG. 4. The length of the shaft body 41 of the wrench 20 of the present invention is more than three times the length of the shaft 14 of the conventional wrench 10 shown in FIG. 1; and therefore, the operating arm of force Q of the wrench 20 is much longer than an arm of force of the conventional wrench 10. Since the operating arm of force Q of the wrench 20 is long, a high torque can be formed to turn the screw connection element, and its torque is several times higher than that of the conventional wrench 10.

The structural design of the wrench 20 that can withstand high-torque operation includes: the disposition of the two grooves 42 makes the cross-section of the shaft body 41 of the shaft 40 to form a specific geometric shape, so that the shaft 40 is still capable of withstanding high torsional loads without bending or breaking despite its long length; and the cross-section of the groove 42 adopts an arcuate design, so that the inner wall surface of the groove 42 does not have sharp angles to prevent stress concentration and reduce the situation of the shaft 40 of the wrench 20 being broken and damaged. Furthermore, the two grooves 42 are capable of reducing a weight of the wrench 20 and making the operation more labor-saving. The cover 50 is screwed at a rear end of the shaft 40 to close the insertion hole 47 to prevent dirt from entering the insertion hole 47.

Figure 9:
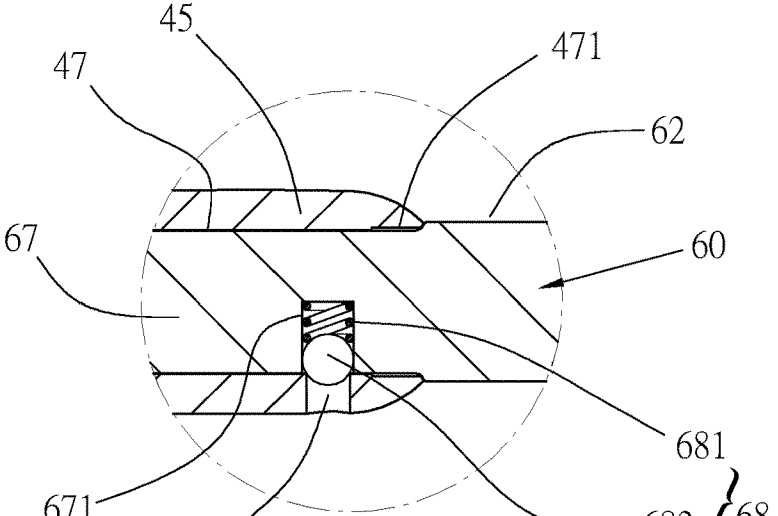
FIG. 9 is a partially enlarged cross-sectional view of FIG. 8.

Please refer to FIG. 8, in another usage mode of the present invention, the wrench 30 and the extension rod 60 are used in combination. The user rotates the cover 50 to remove the cover 50 from the wrench 20 and to expose the insertion hole 47, and then inserts the plug 67 of the extension rod 60 into the insertion hole 47 to make the elastic fastener 68 to be engaged with the fasten hole 48, as shown in FIG. 9, the wrench 20 and the extension rod 60 can be plug-connected together, and the elastic positioning member (i.e. the elastic fastener 68 and the fasten hole 48) keeps the plug 67 positioned in the insertion hole 47. After the extension rod 60 is combined with the wrench 20, the entire extendable wrench has a considerably long extended operating arm of force R (a length from the center C of the driving member 32 to the rear end of the extension rod 60). The user holds the second grip 65 of the extension rod 60 to turn the wrench 20. The extended operating arm of force R is about twice as long as the operating arm of force Q of the wrench 20 itself, so that the entire extendable wrench can provide extra large torque. According to the applicant's physical test, the wrench 20 with the insert column 34 being a size of one-half of an inch can provide an extra large torque of more than 700 feet-pounds (ft-lbs) to achieve a large torque for engineering. The structural design of the shaft 40 of the wrench 20 has high strength and can withstand this extra large torque without deformation or damage.

Figure 10:
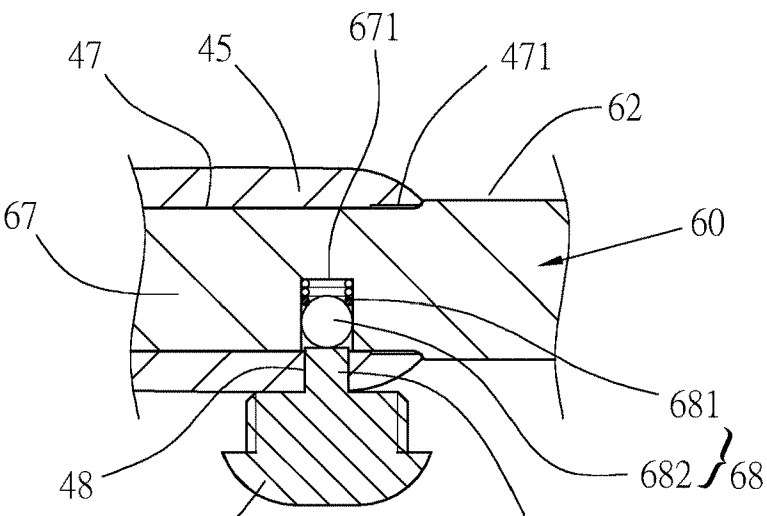
FIG. 10 shows the plug-connected state between the wrench and the extension rod being released by a cover.

If the extension rod 60 needs to be separated from the wrench 20, the present invention provides a simple method for that. Please refer to FIG. 10, the abut stud 54 of the cover 50 is inserted into the fasten hole 48 of the shaft 40, and the fasten body 682 is pushed away from the fasten hole 48, so that the elastic fastener 68 is no longer engaged with the fasten hole 48, and the plug 67 of the extension rod 60 can be removed from the insertion hole 47 of the wrench 20 to separate the extension rod 60 from the wrench 20. Then, the cover 50 is screwed into the insertion hole 47 of the wrench 20.

Figure 11:
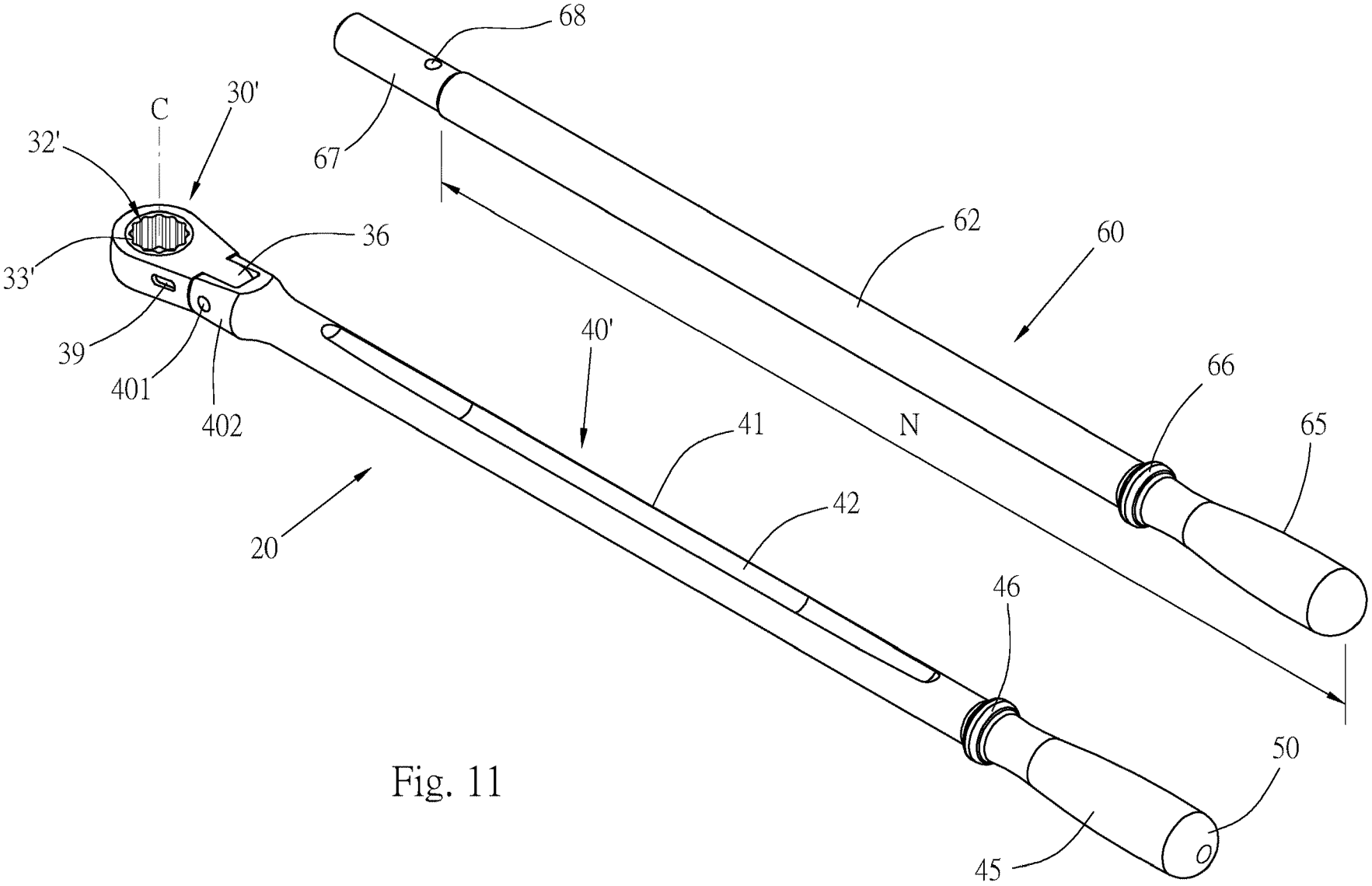
FIG. 11 is a perspective view of the wrench and the extension rod according to a second preferred embodiment of the present invention.

FIG. 11 is a perspective view of the wrench and the extension rod according to a second preferred embodiment of the present invention. The same components are represented by the same component numerals, and the structural features of the components can be referred to the description of the first preferred embodiment, so they are not repeated in detail.

This preferred embodiment also includes a wrench 20' and the extension rod 60, the extension rod 60 is the same as the one in the first preferred embodiment; the wrench 20' also has a head portion 30' and a shaft 40' connected with each other. Wherein a pin-jointed portion 36 at a rear end of the head portion 30' is pivotally connected with a pin jointed portion 402 at a front end of the shaft 40' by a pivot 401. The shaft body 41 of the shaft 40' is a solid structure. The two grooves 42 are provided at a top edge and a bottom edge of a peripheral surface of the shaft body 41 along a longitudinal direction of the shaft body 41. A driving member 32' is provided in the head portion 30'. The driving member 32' is also a ratchet member in this embodiment, and has a ratchet 33'. The ratchet 33' is provided with a polygonal fitting hole 38 that is used to connect and drive a screw connection element or a sleeve. A reversing push rod 39 is inserted in the head portion 30' and capable of controlling the rotational direction of the ratchet 33'. The driving member 32' also has a center C formed at a center of the fitting hole 38. Similarly, a length of the shaft body 41 is not less than three times a length of the grip 45, and the length of the shaft body 41 is 3.1 to 3.8 times the length of the grip 45; a length from the center C of the driving member 32' to an end of the shaft body 41 is about four times the length of the grip 45, preferably, 3.7 to 4.5 times.

Similarly, the extension rod 60 combined with the wrench 20' can form an ultra-long extended operating arm of force (as shown by the symbol R in FIG. 8), which is about twice as long as the operating arm of force Q of the wrench 20' itself to provide large torque required for engineering.

Figure 12:
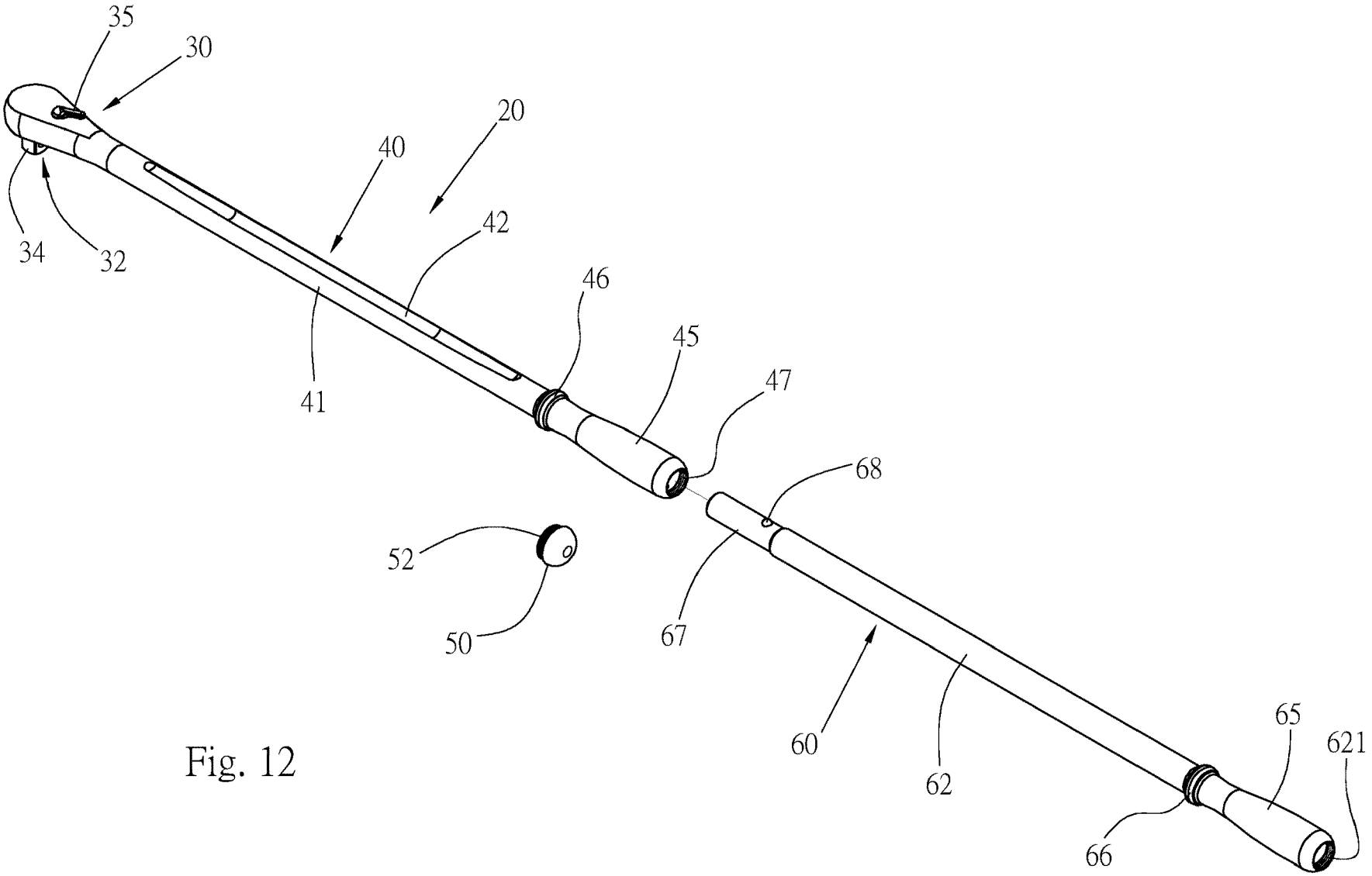
FIG. 12 is a perspective view of the wrench and the extension rod according to a third preferred embodiment of the present invention.
Figure 13:
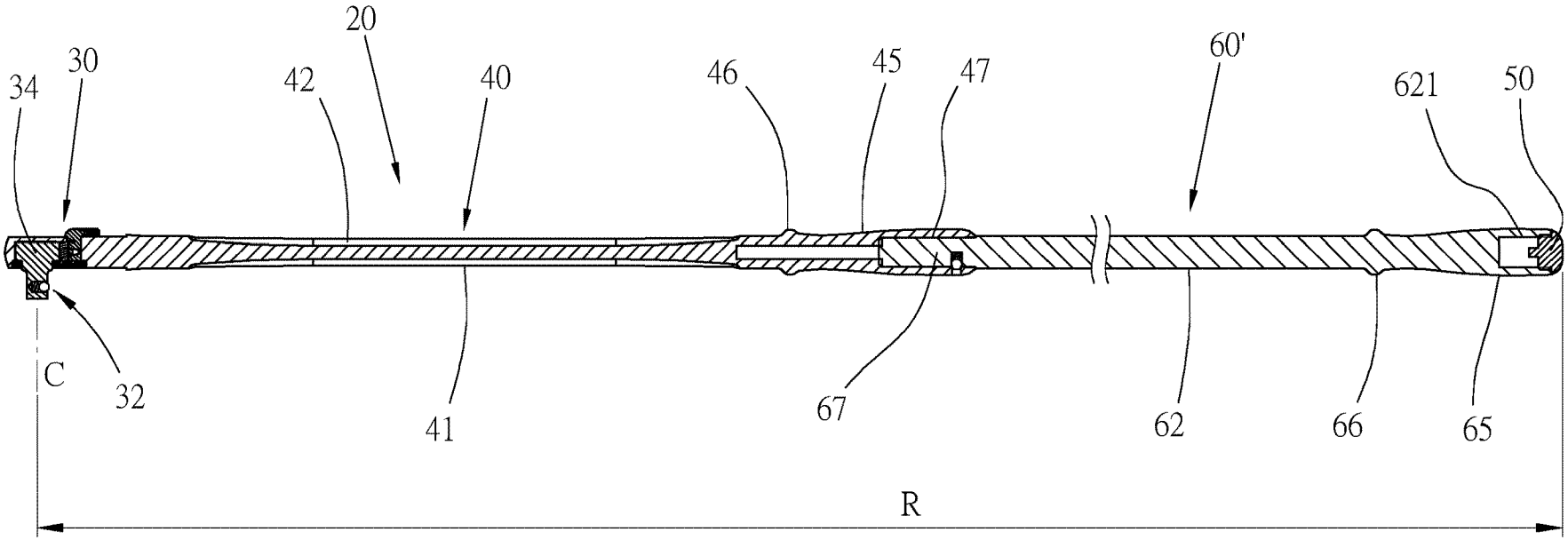
FIG. 13 is a cross-sectional view of the plug-connection between the wrench and the extension rod of FIG. 12.

FIGS. 12 and 13 are a third preferred embodiment of the extendable wrench of the present invention. The same components are represented by the same component numerals, and the structural features of the components can be referred to the description of the first preferred embodiment, so they are not repeated in detail.

In this embodiment, an accommodating hole 621 is recessed at an end of an extension rod 60', and the accommodating hole 621 can be a recessed hole or a screw hole. Please refer to FIG. 13, when the extension rod 60' and the wrench 20 form the extended operating arm of force R, the cover 50 can be accommodated in the accommodating hole 621 to facilitate storage of the cover 50 and avoid loss of the cover 50. After the extension rod 60' is separated from the wrench 20, the cover 50 is removed from a rear end of the extension rod 60' and screwed and connected with the insertion hole 47 of the wrench 20 again. The accommodating hole 621 in this embodiment can be applied to the foregoing first and second preferred embodiments.

Figure 14:
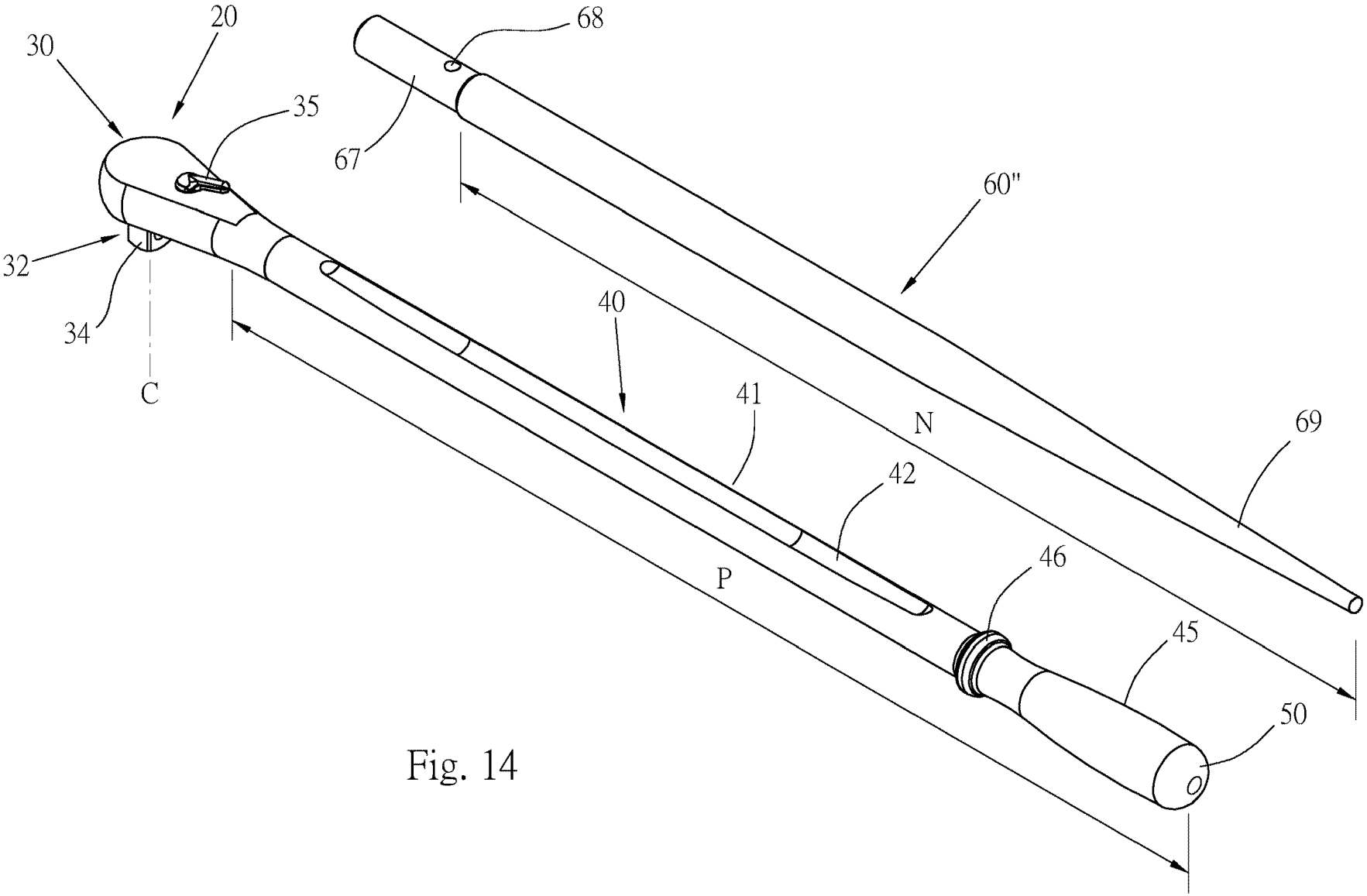
FIG. 14 is a perspective view of the wrench and the extension rod according to a fourth preferred embodiment of the present invention.
Figure 15:
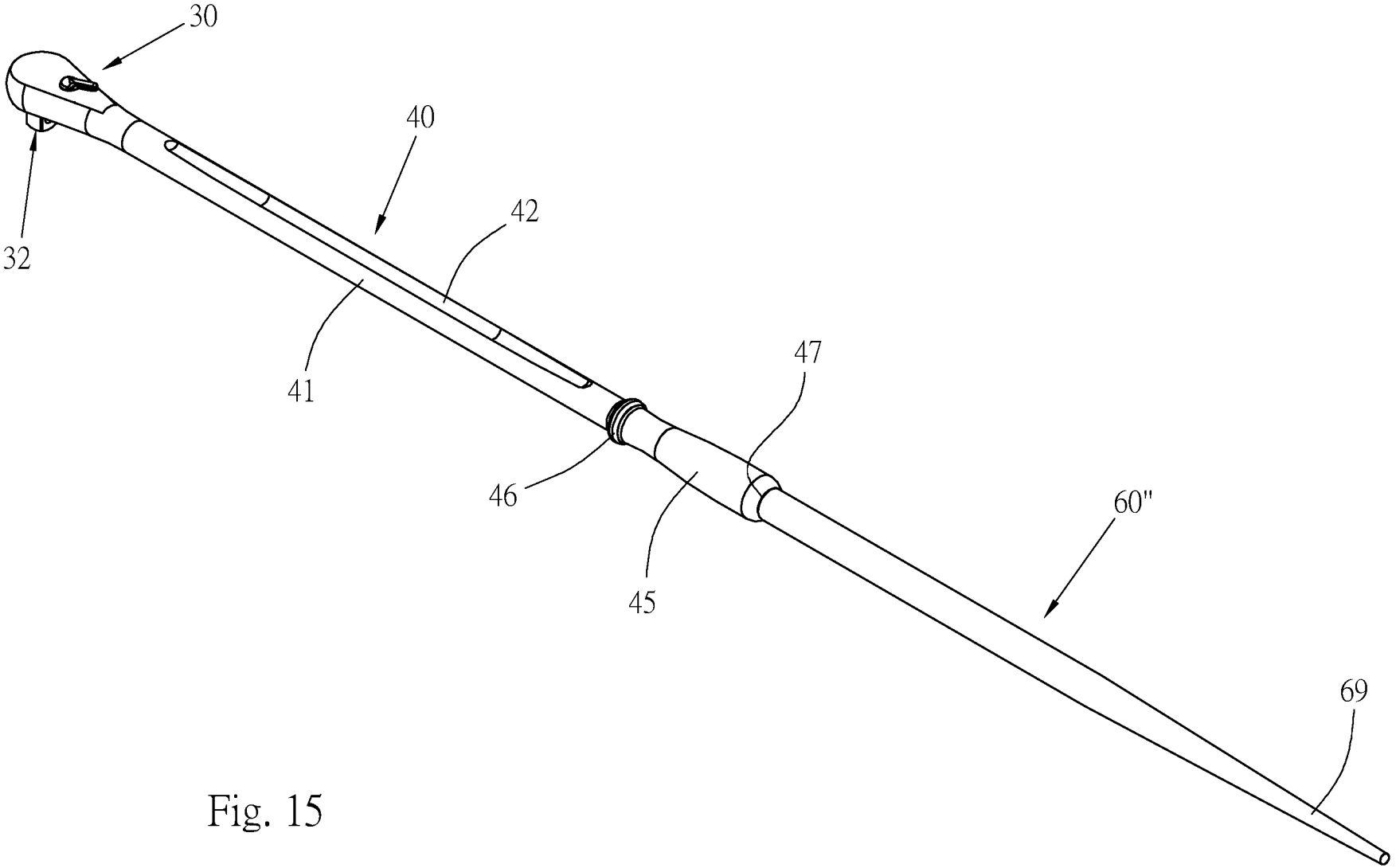
FIG. 15 is a perspective view of the combination of the wrench and the extension rod of FIG. 14.

FIGS. 14 and 15 are a fourth preferred embodiment of the extendable wrench of the present invention. The same components are represented by the same component numerals, which will not be repeated in detail.

This preferred embodiment also includes the wrench 20 and an extension rod 60". The wrench 20 can be the same as shown in the first or second preferred embodiment, and will not be further described. The extension rod 60" has the plug 67 at a front end thereof, and is provided with the elastic fastener 68. In addition, a rear end of the extension rod 60" is tapered into a thin rod portion 69. When the wrench 20 is used to connect two objects with a bolt and a nut, the thin rod portion 69 can be firstly inserted into holes of the two objects to align the two holes, so that the bolt can penetrate the two holes. The way of using the wrench 20 and the extension rod 60" in this embodiment can be referred to the description of the first preferred embodiment.

Figure 16:
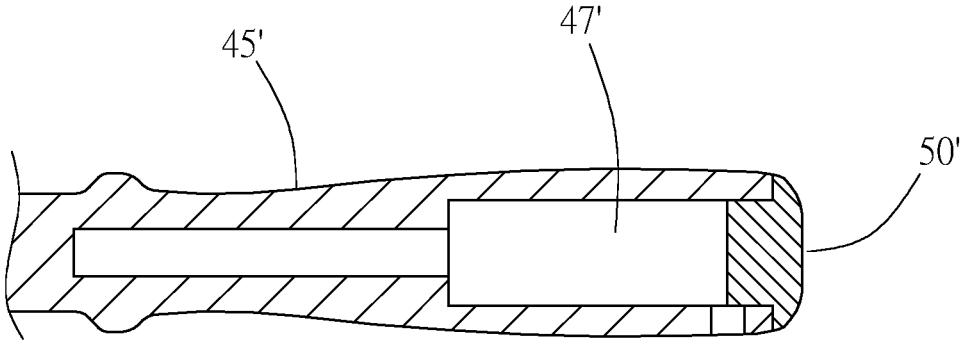
FIGS. 16 to 18 are three preferred embodiments of the cover of the present invention.
Figure 17:
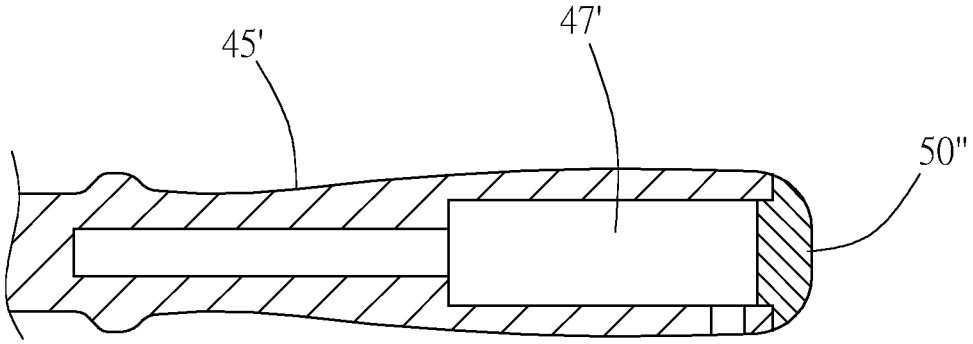
Figure 18:
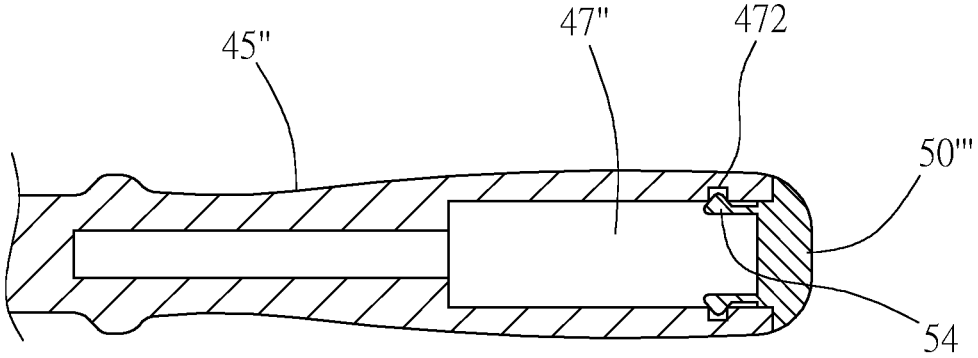

FIGS. 16 to 18 are three preferred embodiments of the cover of the present invention, and the remaining components of the wrench will not be repeated in detail. A cover 50' of FIG. 16 is a soft plug, such as made of rubber or plastic material, which is plugged into a insertion hole 47' at an end of a grip 45' of the shaft to close the insertion hole 47'. A cover 50" of FIG. 17 is magnetic, and is magnetically attached to the end of the grip 45' to close the insertion hole 47'. An inner end surface of a cover 50'" of FIG. 18 is extended with at least one elastic fasten portion 54 inwardly, for example, two fasten portions 54 are provided. When the cover 50'" covers a insertion hole 47" of a grip 45", the two fasten portions 54 are elastically engaged with recesses 472 of a hole wall of the insertion hole 47". The three covers 50', 50", 50'" can be removed from the insertion holes, so that the extension rods can be inserted into the insertion holes.

The structural design of the wrenches 20 and 20' of the present invention can withstand high-torque operation, the disposition of the two grooves 42 makes the cross-section of the shaft 40 to form a specific geometric shape, so that the shaft 40 is still capable of withstanding high torsional loads without bending or breaking despite its long length. The cross-section of the groove 42 adopts an arcuate design, so that the inner wall surface of the groove 42 does not have sharp angles to prevent stress concentration and reduce the situation of the shaft body 41 of the wrench being broken and damaged. Moreover, the two grooves 42 are capable of reducing a weight of the wrench and making the operation more labor-saving.

When application of ultra-large torque is required, the extension rod of the present invention can be combined with the wrench to meet the requirements of ultra-large torque required by the engineering grade.

It is to be understood that the above description is only preferred embodiments of the present invention and is not used to limit the present invention, and changes in accordance with the concepts of the present invention may be made without departing from the spirit of the present invention, for example, the equivalent effects produced by various transformations, variations, modifications and applications made to the configurations or arrangements shall still fall within the scope covered by the appended claims of the present invention.

The above embodiments are only used to illustrate the present invention, not intended to limit the scope thereof. Many modifications of the above embodiments can be made without departing from the spirit of the present invention.

What is claimed is:

1. An extendable wrench comprising:

a wrench having a head portion and a shaft connected to a rear end of the head portion; a driving member being disposed at the head portion;

an insertion hole recessed at a rear end of the shaft;

a cover dismountably installed at the rear end of the shaft to close the insertion hole;

an extension rod with a length at least half of a length of the shaft; a plug being formed at a front end of the extension rod, and the plug of the extension rod being separably plug-connected with the insertion hole of the wrench; and an elastic positioning member provided between the plug of the extension rod and the insertion hole of the wrench, when the plug of the extension rod being plug-connected with the insertion hole, the elastic positioning member keeping the plug in position;

wherein the elastic positioning member includes a fasten hole and an elastic fastener, the fasten hole is provided at a wall of the insertion hole, the elastic fastener is provided at the plug, when the plug of the extension rod is plug-connected with the insertion hole, the elastic fastener is engaged with the fasten hole;

wherein the fasten hole penetrates an outer peripheral surface of the shaft; an abut stud is disposed on an inner end surface of the cover, and the abut stud is capable of inserting into the fasten hole.

2. The wrench as claimed in claim 1, wherein the cover is screwed and connected with the insertion hole.

3. The wrench as claimed in claim 1, wherein the extension rod has a shaft body and a grip connected to a rear end of the shaft body, and the plug is formed at a front end of the shaft body.

4. The wrench as claimed in claim 3, wherein a protruding ring is disposed on the extension rod, and located at an intersection of the shaft body and the grip, and an outer diameter of the protruding ring is larger than an outer diameter of the shaft body.

5. The wrench as claimed in claim 1, wherein at least one groove is provided on a peripheral surface of the shaft along a longitudinal direction of the shaft.

6. The wrench as claimed in claim 1, wherein the shaft of the wrench has a shaft body and a grip connected to a rear end of the shaft body, and a length of the shaft body of the shaft is twice or more than twice a length of the grip of the shaft.

7. The wrench as claimed in claim 6, wherein the shaft body of the shaft is a solid structure, and at least one groove is provided on a peripheral surface of the shaft body along a longitudinal direction of the shaft.

8. The wrench as claimed in claim 6, wherein a length of the extension rod is about the same as a length of the shaft.

9. The wrench as claimed in claim 6, wherein a protruding ring is disposed at an intersection of the shaft body and the grip, and an outer diameter of the protruding ring is larger than an outer diameter of the shaft body.

10. The wrench as claimed in claim 1, wherein the wrench has an operating arm of force, which is a length formed between the driving member and the rear end of the shaft; an extended operating arm of force is formed when the extension rod being plug-connected with the wrench, which is a length formed between the driving member and a rear end of the extension rod, and a length of the extended operating arm of force is more than 1.5 times a length of the operating arm of force of the wrench.

11. The wrench as claimed in claim 1, wherein an accommodating hole is disposed at an end of the extension rod, and the cover can be accommodated in the accommodating hole.

12. The wrench as claimed in claim 1, wherein the rear end of the extension rod is formed with a thin rod portion.

13. The wrench as claimed in claim 1, wherein the cover is made of a soft material and is plugged into the insertion hole of the shaft.

14. The wrench as claimed in claim 1, wherein the cover is magnetic, and is magnetically attached to the end of the shaft to close the insertion hole.

15. The wrench as claimed in claim 1, wherein at least one recess is disposed at the hole wall of the insertion hole, a fasten portion is disposed on an end surface of the cover, when the cover covers the insertion hole, the fasten portion is separably engaged with the recess.

* * * * *